United States Patent [19]

Watanabe

[11] 4,070,758

[45] Jan. 31, 1978

[54] STRAIGHTEDGE SUPPORTING DEVICE FOR RAIL TYPE DRAWING INSTRUMENT

[75] Inventor: Yoshinori Watanabe, Tokyo, Japan

[73] Assignee: Mutoh Industry Ltd., Tokyo, Japan

[21] Appl. No.: 749,084

[22] Filed: Dec. 9, 1976

[30] Foreign Application Priority Data

Dec. 20, 1976 Japan ..... 51-152304

[51] Int. Cl.[2] ..... B43L 13/02

[52] U.S. Cl. ..... 33/76 R

[58] Field of Search ..... 33/76 R, 79

[56] References Cited

U.S. PATENT DOCUMENTS 3,564,720 2/1971 Komura ..... 33/79 R

FOREIGN PATENT DOCUMENTS 648,123 12/1950 United Kingdom ..... 33/79 R

*Primary Examiner*—Harry N. Haroian

*Attorney, Agent, or Firm*—Wenderoth, Lind & Ponack

[57] ABSTRACT

A straightedge supporting device for rail type drawing instrument which has a cross rail capable of being manually shifted in a desired direction on a drawing board while remaining in a predetermined orientation, a head supported by a longitudinal rail on the drawing board, a ruler mounting plate mounted on the head for rotation in a plane parallel to the surface of the drawing board, a fixing element for detachably fixing the ruler mounting plate to the head and disengaging it therefrom, and a straightedge mounted on the ruler mounting plate. The improved straightedge supporting device operates such that when the drawing board is tilted and the straightedge is not fixed to the head, a turning force is applied to the ruler mounting plate in the opposite direction to the turning moment which tends to cause the straightedge to swing downwardly along the surface of the drawing board due to its own weight, so that the straightedge remains in a stable static condition on the inclined drawing board at a desired angle to the head.

6 Claims, 10 Drawing Figures

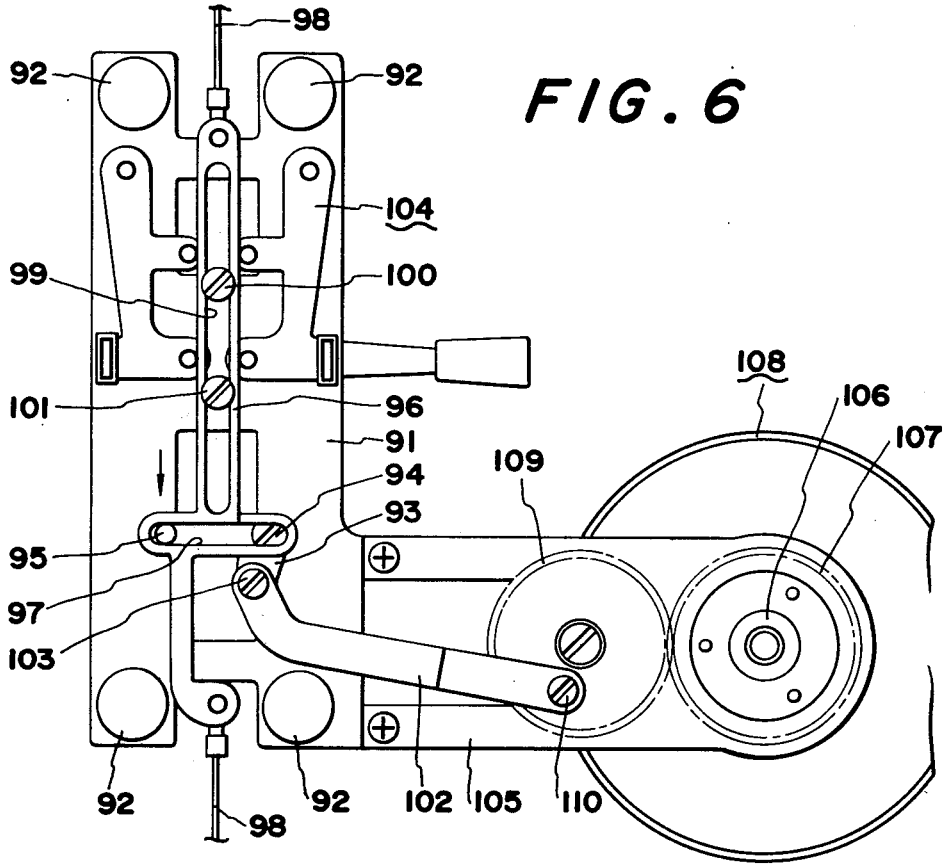
FIG. 6
FIG. 7
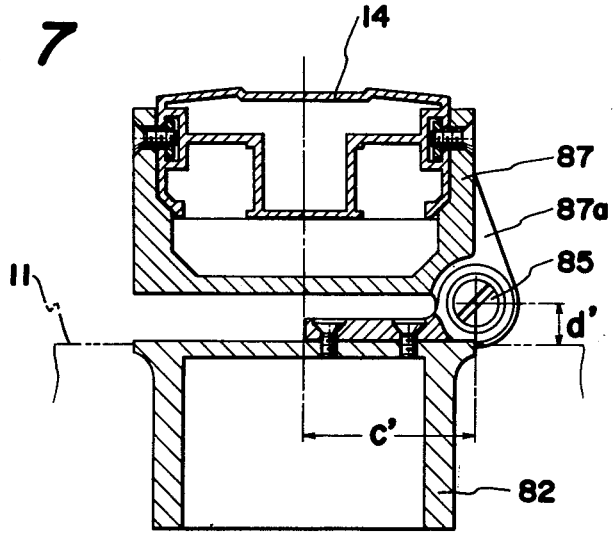

STRAIGHTEDGE SUPPORTING DEVICE FOR RAIL TYPE DRAWING INSTRUMENT

DESCRIPTION OF PRIOR ART

In a rail type drawing instrument, a ruler mounting plate is mounted on a head so as to be rotatable in a plane parallel with the surface of a drawing board, and the head is supported by a cross rail and a longitudinal rail on the drawing board so that the head can be shifted in an arbitrary direction on the drawing board while keeping a predetermined orientation. On such a ruler mounting plate is mounted a straightedge. Between the head and the ruler mounting plate is provided means to fix the mounting plate to the head and release it from the head. An operator releases the ruler mounting plate from the head so that the ruler mounting plate is free to turn with respect to the head so that he can change the angle of orientation the ruler mounting plate, namely, the direction of the straightedge to a desired angle or direction by manual operation. When the drawing board is tilted during use at a steep gradient, and the ruler mounting plate is released from the head, the straightedge will make turn downwardly due to its own weight along the surface of the drawing board. Accordingly, the operator is required to grip a handle interlocked with the ruler mounting plate and to apply thereto a force opposing the turning force of the ruler mounting plate due to the downward swinging of the straightedge to prevent the turning of the straightedge in the downward direction. Also, there is a drawback that the straightedge cannot be turned smoothly with a small turning force.

SUMMARY OF THE INVENTION

The present invention relates to a straightedge supporting device for rail type drawing instrument provided with a cross rail and a longitudinal rail.

A primary object of the present invention is to provide a structure which, when the straightedge is freely rotatable around the head, produces a dynamic force resulting from a weight and which is in the opposite direction to the force which is produced by the rotation of the straightedge downwardly along the surface of the inclined drawing board which is caused by the weight of the straightedge, and the swiveling movement of the straightedge around the head, namely, direction changing manipulation of the straightedge, can be performed smoothly with a small turning force. Another object of the present invention is to provide a structure in which a dynamic force due to the weight completely balances the rotational force produced by rotation of the straightedge around the head which is caused by the weight of the straightedge, and the straightedge is prevented from such rotational motion due to its own weight along the surface of the inclined drawing board and the straightedge is stably supported by the head in a desired orientation to the remainder of the drawing instrument. When the straightedge is stably supported by the head in a desired orientation, an operator is not required to apply a force to a handle connected to the ruler mounting plate to stop swiveling motion of the straightedge in the downward direction, and drafting work using the drawing instrument of this invention can be efficiently carried out.

A further object of the present invention is to provide a structure in which a weight which is shiftable along a longitudinal direction of the longitudinal rail is used for both a balancing unit for the straightedge and a balancing unit for the head so that the entire structure can be simply manufactured.

These and other objects and advantages of the present invention will become more apparent as the description proceeds with reference to the drawings. The drawings show preferred embodiments of the present invention and a description will be provided for such embodiments. While the following description deals with the application of the present invention to a straightedge supporting device, it should be understood that the invention is not limited thereto, but may be incorporated into a straightedge supporting device and a variety of modifications are possible.

BRIEF DESCRIPTION OF THE DRAWINGS

FIG. 6 is a plan view similar to FIG. 3 of another embodiment of the straightedge supporting device.

FIG. 7 is a cross-sectional view taken along line 7—7 of FIG. 1.

DETAILED DESCRIPTION OF THE INVENTION

Figure 1:
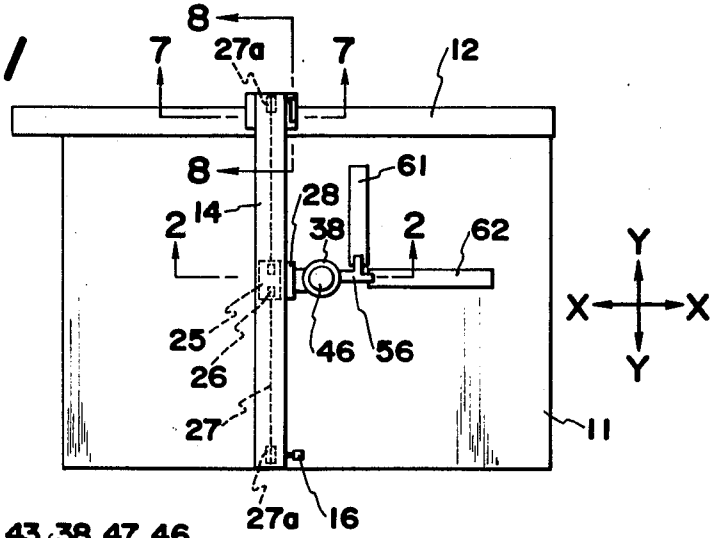
FIG. 1 is a plan view of the entire rail type drawing instrument.
Figure 2:
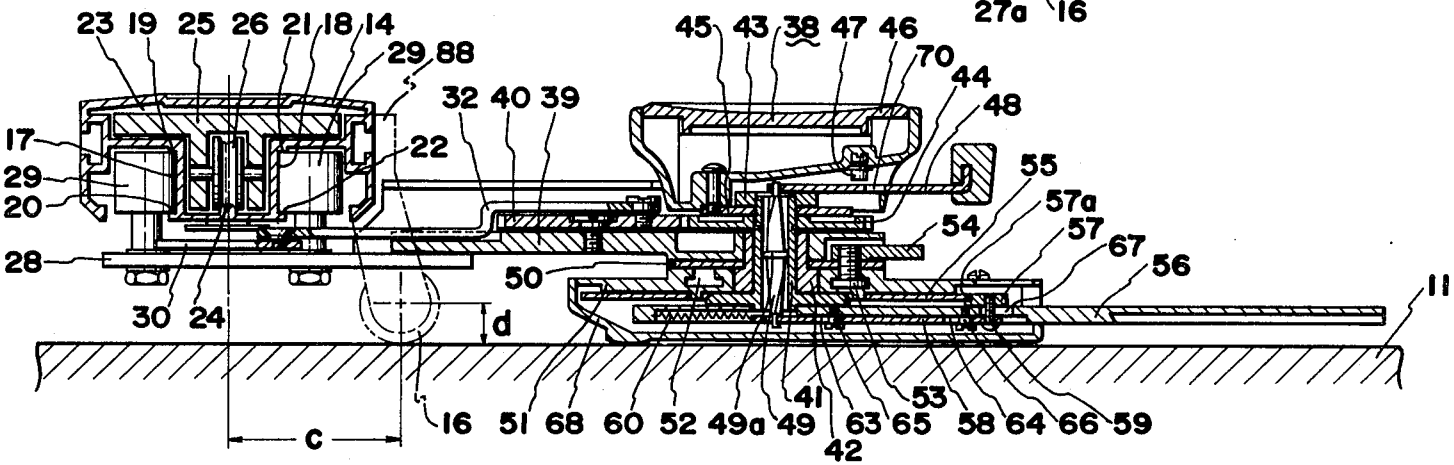
FIG. 2 is a cross-sectional view along line 2—2 of FIG. 1.
Figure 3:
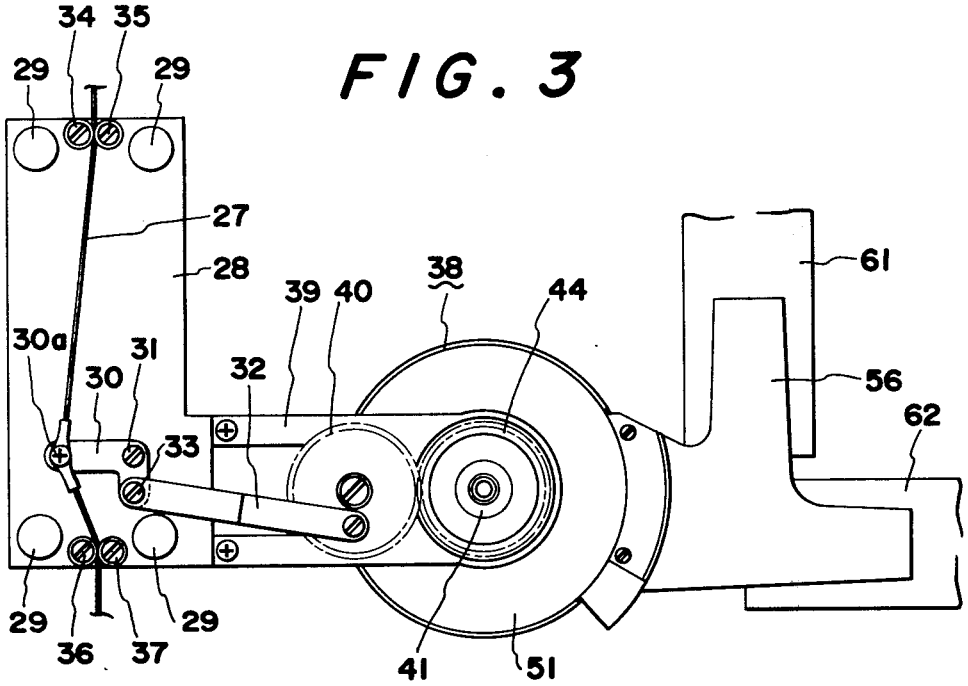
FIG. 3 is a plan view, on an enlarged scale, of a straightedge supporting device.
Figure 4:
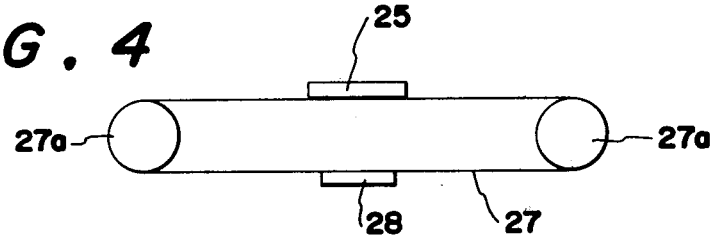
FIG. 4 is an explanatory diagram of the means for moving the head along the longitudinal rail.

Referring first to FIGS. 1-4, 7 & 8, numeral 11 denotes a drawing board which is supported on a reclining table (not shown) so that it can be fixed at a desired angle of inclination. Numeral 12 denotes a cross rail disposed on the upper side of the drawing board 11, and a cross cursor 81 is slidably mounted on the cross rail. A connecting member 82 (refer to FIGS. 7 and 8) is connected to the cross cursor 81 in a predetermined position so as to be pivotable around a shaft 83, and on the upper surface of the connecting member 82 is fixed a pivotable support member 84 by means of a set screw. Shafts 85 and 86 are fixed to the pivotal support member 84 parallel with the surface of the drawing board 11 and at right angles to the longitudinal direction of the cross rail 12. Numeral 87 denotes a mounting frame fixed to one end of a longitudinal rail 14 by means of a set screw, and the frame 87 has projecting portions **87*a* and 87*b* through which holes are formed, and the shafts 85 and 86 are fitted into the holes in ball bearings mounted in the holes. The longitudinal rail 14 is parallel with the surface of the drawing board 11 at right angles to the longitudinal direction of the cross rail 12. An arm 88 is fixed to the lower end of the longitudinal rail 14 by means of a set screw, and a tail end roller 16 is rotatably supported on the lower end of the arm 88 so that it can turn during movement of longitudinal rail 14 in a direction parallel to the cross rail 12. On the longitudinal rail 14, as shown in FIG. 2, vertical rail surfaces 17 and 18** and horizontal rail surfaces 19, 20 and 21, 22 are formed in the longitudinal direction thereof, and in the center of the longitudinal rail 14 is provided a weight accommodating space 23, and on the bottom surface is provided a convex roller surface 24. In the space 23 is provided a balance weight 25, and a roller 26 rotatably supported on the weight 25 for rotation around the axis thereof contacts and rolls on the roller surface 24. At both ends of the weight 25 are connected a wire rope 27 formed in loop and the rope 27, as shown in FIG. 4, extends around guide pulleys 27*a* rotatably mounted at both ends of the longitudinal rail 14. Numeral 28 denotes a longitudinal cursor and four rollers 29 are rotatably mounted on a shafts vertically mounted on the longitudinal cursor, and two of the rollers 29 are in rotatable contact with a channel in the longitudinal rail 14 by the vertical rail surface 17 and horizontal rail surfaces 19 and 20 and two of the rollers 29 are in rotatable contact with a channel formed by vertical rail surface 18 and horizontal rail surfaces 21 and 22. Numeral 30 denotes an L-shaped member supported on a shaft 31 rotatably mounted on the longitudinal cursor and which is a member that is interlocked with the head of the straightedge, so as to be displaced upon rotation of said head and one end of the member, namely, a displacing portion 30*a* is connected with the wire rope 27, and on the other end 33 of the member 30 is pivotally mounted one end of a connecting lever 32. Numerals 34, 35, 36, and 37 denote rope guides disposed at both ends of the longitudinal cursor 28, and between the pairs of guides 34, 35 and 36, 37 is guided the rope 27 which is frictionally held between the guides to normally hold the cursor 28 in position on the rope 27. Numeral 38 denotes a head and the internal structure thereof is shown in detail in FIG. 2.

Numeral 39 denotes a head support plate fixed to the longitudinal cursor 28, and a gear 40 is rotatably pivotally supported on the head support plate. At an eccentric position on the gear 40 is pivotally connected the other end of the connecting level. Numeral 41 denotes a rotary tube, and on its outer periphery is fixed an outer tube 42 and moreover on the upper part of the rotary tube 41 are mounted a gear 44 and a mounting plate 45 by means of a nut 43. Around the outer periphery of the outer tube 42 is rotatably fitted a tube portion of the head support plate 39. The gears 44 and 40 are meshed. On the mounting plate 45 is fixed a grip handle 46 is fixed, and from the handle 46 projects a projection 47 which acts as a stop. Numeral 48 denotes an index lever, and one end portion thereof is coupled to the upper end of a conical bar 49 disposed in the rotary tube 41 and which has an enlarged portion 49*a* rotatable in the tube 41. Numeral 50 denotes a plate member fixed to the support plate 39, and 51 denotes a protractor rotatably mounted on the outer periphery of a flange portion of the outer tube 42, and the protractor 51 is detachably fixed to the plate member 50 at the desired angle by means of a nut member 54 threaded on to a threaded shaft 53 disposed in a circumferential groove 52 having T-shaped cross section which is provided in the protractor 51. Numeral 55 denotes an index ring fixed to the protractor 51, and on its outer periphery are provided concave index portions (not shown) at predetermined intervals. Numeral 56 denotes a ruler mounting plate fixed to the undersurface of the rotary tube 41, and on its upper surface is pivotally fixed an intermediate portion of an index pawl 57 and at the free end of the index pawl 57 is pivotally mounted one end of a transfer lever 58 by means of a shaft 59, and a pawl portion 57*a* of the index pawl 57 is fitted in one of the concave index portions of the index ring 55. To the lower end of the conical bar 49 is coupled the transfer lever 58 is coupled. Numeral 60 denotes a spring disposed on the undersurface of the ruler mounting plate 56, and the transfer lever 58 is urged to the left in FIG. 2 by means of the spring. The index lever 48, conical bar 49, index ring 55, and index pawl 57 constitute means to fix the ruler mounting plate 56 to the head support plate 39 and to release the fixed connection of the ruler mounting plate 56 to the head support plate 39. Straightedges 61 and 62 are detachably fixed to the ruler mounting plate 56. Numerals 63 and 64 denote long holes that run through the transfer lever 58, and screws 65 and 66 fixed to the ruler mounting plate 56 are disposed in the long holes. Numeral 67 denotes a long hole that runs through the mounting plate 56, and the shaft 59 is disposed in the long hole. Numeral 68 denotes a bottom cover fixed to the protractor 51.

In FIG. 7, the space *d'* between the center axis of shafts 85 and 86 and the plane of the surface of the drawing board 11 and the space between the center of the tail portion roller 16 and the surface of the drawing board 11 are identical, and also the space *c'* in the X-coordinate direction in the X-Y coordinages plane between a perpendicular to the surface of the drawing board 11 through the center of the longitudinal rail 14 and a perpendicular to the surface of the drawing board 11 through the center of the shafts 85 and 86, and a space *c* in the X-coordinate direction between a perpendicular to the surface of the drawing board 11 through the center of the longitudinal rail 14 and a perpendicular to the surface of the drawing board 11 through the center of the roller 16 are identical. A turning moment in the counter-clockwise direction in FIG. 2 around the shafts 85 and 86 and roller 16 generated by the weight of the longitudinal rail 14, etc. is thus identical with the turning moment in the clockwise turning direction in FIG. 2 around the shafts 85 and 86 and the roller 16 generated by the weight of the head 38, etc., and the head 38 is stably retained at an arbitrary contacting and separating position relative to the surface of the drawing board 11. This balanced condition of the head will not be disturbed even if the drawing board 11 is turned around an axis in parallel to the cross rail 12 and the angle of inclination of the drawing board 11 is changed.

Next, the operation of the embodiment of the present invention will be described.

In the first place, the drawing board 11 is set at a desired angle to the horizontal. The grip handle 46 of the head 38 is grasped in one's hand and a force is applied to the grip handle 46 parallel with the surface of the drawing board 11 to shift the longitudinal rail 14 in the left or the right direction in FIG. 1 along the cross rail 12, and the longitudinal cursor 28 is shifted along the perpendicular rail surfaces 17, 18 of the longitudinal rail 14, and with the head 38 retained in a predetermined position, the head 38 can be shifted to a desired position on the drawing board 11. When the longitudinal cursor 28 is shifted along the longitudinal rail 14, the weight 25 which is connected to the longitudinal cursor 28 by means of the rope 27 is shifted in the opposite direction along the longitudinal rail 14. When the hand is removed from the grip handle 46 after the head 38 is stopped at a desired position on the drawing board 11, the dynamic force tending to cause the longitudinal cursor 28 to drop downwardly along the drawing board 11 along the longitudinal rail 14 due to the weight of the head 38, straightedges 61 and 62 and longitudinal cursor 28 is balanced by the dynamic force of the balance weight 25 tending to move downwardly along the drawing board 11 along the longitudinal rail 14 due to its own weight, and therefore the longitudinal cursor 28 and the head 38 are statically and stably stopped at an arbitrary stop position. When the index lever 48 is shifted in the left direction by manual operation, and the stop projection 47 is fitted into the hole 70, the conical bar 49 interlocked with the index lever 48 is pivoted in the counter-clockwise direction in FIG. 2 about the fulcrum constituted by the enlarged portion 49*a*, and the transfer lever 58 is shifted to the right sliding on the screws 65 and 66, and the index pawl 57 is turned about the pivotal mounting thereof, and the pawl portion 57*a* is separated from the outer periphery of the index ring 55 and the concave portion of the ring 55 and the pawl portion 57*a* are disengaged. Thus the ruler mounting plate 56 is released from the head support plate 39. In this condition, the turning moment due to the weight of the straightedges 61 and 62 is applied to the rotary tube 41. This turning moment is transmitted to the member 30 that is displaced because it is interlocked with the straightedges by means of the gears 44 and 40 and the connecting lever 32, and the member 30 has a turning force applied thereto in the counter-clockwise turning direction in FIG. 3 around the pivotal shaft 31. The turning moment of the turning member 30, namely, the L-shaped member 30 in the clockwise direction around the pivotal mounting thereof due to the gravity of the weight 25 is balanced by the turning force in the counter-clockwise turning direction, and the straightedges 61 and 62 are stably supported on the head support plate 39 and the straightedge 61 and 62 are not turned downwardly along the drawing board around the head 38.

To make the magnitude of the turning moment transmitted by the L-shaped member 30 due to the weight of the straightedges 61 and 62 coincide with magnitude of the turning moment in the opposite direction the gear ratio of the gears it is possible to properly design the gear ratio of the gears 44 and 40 the amount of eccentricity of the connecting lever 32 mounted on the gear 40, and the dimensions of the L-shaped member 30 must be properly designed. Thus the L-shaped member 30, connecting lever 32, and gears 40 and 44 constitute turning force converting means.

In the condition where the index pawl 57 and index ring 55 are disengaged, if the grip handle 46 is turned by manual operation, the rotary tube 41 is turned, and the straightedges 61 and 62 are turned around the rotary tube 41 on the drawing board 11, in other words, the strightedges 61 and 62 are turned around the head 38, and the orientation of the straightedges 61 and 62 can be changed. The turning of the handle 46 can be carried out with a small force.

Figure 5:
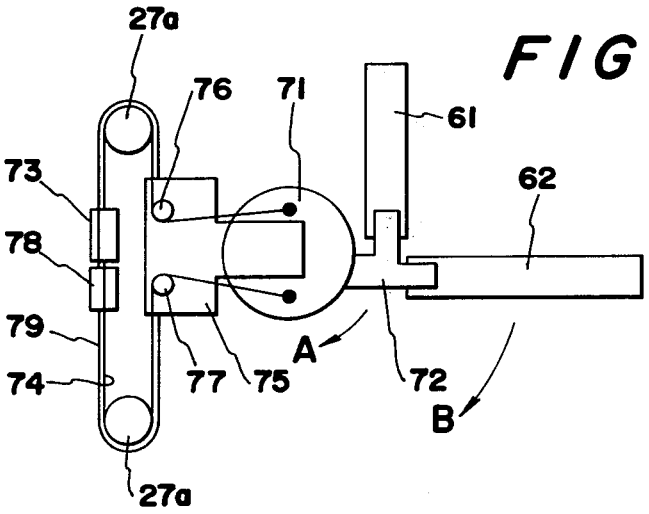
FIG. 5 is an explanatory diagram showing another embodiment of the present invention.

Next, another embodiment of the present invention will be described with reference to FIG. 5.

Reference numeral 71 denotes a member that is displaced because it is interlocked with straightedges and is mounted rotatably on the head (not shown) provided on the longitudinal cursor 75 by means (not shown) for fixing the ruler mounting plate 72 on the member 71 and disengaging it therefrom. One of the ropes 74 connected to a balance weight 73 for the straightedges is connected to an eccentric position on the member 71 after being led over a guide pulley 76 provided on the longitudinal cursor 75, and the other rope 74 is connected to an eccentric position on the member 71 after being led over a guide pulley 77 provided on the longitudinal cursor 75. The longitudinal cursor 75 is connected by rope 79 to a balance weight 78 for cursor in the same manner as the rope 27 and weight 25. The other construction is almost identical with that of the preceding embodiment.

The magnitude of the turning moment in the direction of arrow A generated on the member 71 due to the weight of the ruler mounting plate 72 and the straightedges 61 and 62, etc. while the member 71 is disengaged from the head is identical with the magnitude of the turning moment generated in the member 71 due to the weight of the balance weight 73. Since the directions of the turning moments acting on the member 71 are opposite, the moments are mutually balanced and offset, and the straightedges 61 and 62 are not turned and do not swing down in the direction of the arrow B and are held stably in position on the inclined drawing board (not shown). Also, the dynamic force of the longitudinal cursor 75 in the downward direction along the longitudinal rail (not shown) is balanced by the total weight of the balance weights 73 and 78, and even if the handle of the head is released, the longitudinal cursor 75 remains stationary at an arbitrary position on the longitudinal rail. When the handle is turned by one's hand, the member 71 is turned, and the orientation of the straightedges 61 and 62 can be changed. The weights 73 and 78 are constructed in such a way that the weights will collide with each other.

Next, a further embodiment of the present invention will be described with reference to FIG. 6.

Reference numeral 91 denotes a longitudinal cursor, and four rollers 92 are rotatably mounted on shafts on the cursor, and each of the rollers 92 is rotatable and is in rolling contact with the grooves defined by the vertical rail surfaces and the horizontal rail surfaces on the longitudinal rail. Numeral 93 denotes an L-shaped member rotatably supported on a shaft 94 on the longitudinal cursor 91 and on one end of lever 93 is a shaft 95 having a head on its one end and is fitted into a lateral long hole 97 formed in a lever 96 at right angles to the longitudinal direction of the longitudinal rail. At both ends of the lever 96 is connected a wire rope 98. The other end of the wire rope 98 is connected to the ends of the weight 25 as shown in FIG. 1, and also the wire rope 98 extends around the guide pulleys rotatably mounted at both ends of the longitudinal rail. In the lever 96 is formed a long hole 99 parallel to the longitudinal direction of the longitudinal rail, and in the long hole 99 are slidably fitted the shaft portions of headed pins 100 and 101 projected outwardly from the cursor 91. To the other end of the L-shaped member 93 at 103 is pivotally connected one end of the connecting lever 102. Numeral 104 denotes a brake device for detachably fixing the longitudinal cursor 91 at a proper location along the longitudinal rail. Numeral 105 denotes a head support plate fixed to the longitudinal cursor 91, and in a tubular portion thereof is rotatably a rotary tube 106. On the rotary tube 106 is fixed a gear 107. Moreover, on the rotary tube 106 are fixed a grip handle and ruler mounting plate. An addition inside of the head 108 are provided indexing means to engage and disengage the rotary tube 106 and the head support plate 105 at a predetermined angle, for example 30° and means (not shown) engage and disengage the rotary tube 106 and the head support plate 105 at a desired angle of rotation. When the rotary tube 106 is disengaged from the head support plate, the rotary tube 106 becomes free and the head support plate 105 is freely rotatable. Numeral 109 denotes a gear pivotally rotatably supported on the head support plate 105, and it is meshed with the gear 105. The other end of the connecting lever 102 is pivotally 110 rotatably supported on an eccentric portion of the gear 109.

Next, the operation of this embodiment will be described.

Figure 9:
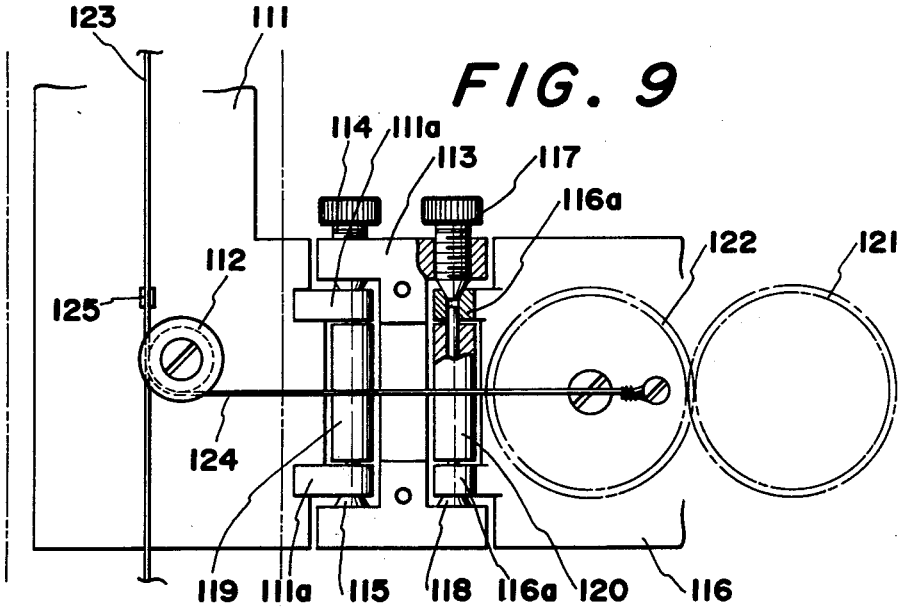
FIG. 9 is a plan view, partly in section, similar to FIG. 3 of another embodiment of the straightedge supporting device.
Figure 10:
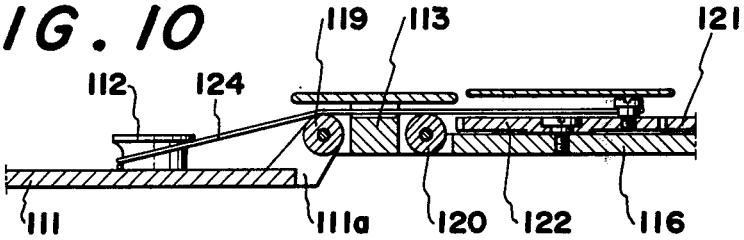
FIG. 10 is a sectional view of the straightedge supporting device of FIG. 9.

When the head 108 is stopped at a desired position on the inclined drawing board and the grip handle is out of ones hand, the dynamic force of the longitudinal cursor 91 due to its tendency to fall in the downward direction along the longitudinal rail due to the weight of the head 108, straightedge and longitudinal cursor 91, etc. is balanced by the dynamic force of the balance weight due to its tendency to fall in the downward direction of the drawing board along the longitudinal rail due to its own weight, and therefore the longitudinal cursor 91 and head 108 remain stably positioned at an arbitrary position along the longitudinal rail. When the rotary tube 106 is disengaged from the head support plate 105 and the rotary tube 106 is free, a turning moment due to the weight of the straightedge, etc. is applied to the rotary tube 106. This turning moment is transmitted to the L-shaped member 93 by means of the gears 107 and 109 and connecting lever 102, and there is applied to the L-shaped member 93 a turning force in the counterclockwise direction in FIG. 6 around the pivotal shaft 94, and the shaft 95 projecting from one end of the L-shaped member 93 through hole 97 in lever 96 causes the lever 96 to shift in the direction of the arrow in FIG. 6 against the force of gravity acting on the balance weight. The force in the direction of the arrow on the L-shaped member acting on the lever 96 is balanced by a force working on the lever 96 in the direction opposite to the direction of the arrow due to gravity acting on the balance weight, and the rotary tube 106, and hence the straightedges are supported stably with the head support plate 105. Accordingly, the straightedge are not swung downwardly around the rotary tube 106 in the downward direction along the inclined drawing board. In the condition where the rotary tube 106 is free, when the grip handle is turned by manual operation, the rotary tube 106 is turned, and the orientation of the straightedges can be changed in the desired direction around the head on the drawing board. Next, another embodiment will be described with reference to FIGS. 9 and 10.

Numeral 111 denotes a longitudinal cursor mounted slidably on a longitudinal rail, and rope pulleys 112 plate rotatably supported on the longitudinal cursor. On each of the outer surfaces of upwardly projecting portions 111*a* and on the longitudinal cursor 111, a pivot bearing is provided, and rotatably fitted into the pivot bearings are the tips of pivotal shafts 114 and 115 threaded into threaded holes in a connecting member 113. Numeral 116 denotes a head support plate, and on the outer surfaces of the projecting portions 116*a* are pivot bearings into which are rotatably fitted the tips of pivotal shafts 117 and 118 threaded into threaded holes in the connecting member 113. Numerals 119 and 120 denote rope guide pulleys which are rotatably pivotally supported between portions 111*a* of the longitudinal cursor 111 and projecting portions 116*a* of the head support plate 116, respectively. Numeral 121 denotes a gear corresponding to the gear 44 in FIG. 3, and the gear 121 is meshed with a gear 122 pivotally rotatably supported on the head support plate 116. Numeral 123 denotes a rope connected to a balance weight, and the rope 123 is connected to one end of a further rope 124 by means of a stationary metal fixture 125, and the other end on the rope 124 is fixed to an eccentric position of the gear 122 by means of a set screw. The rope 124 is guided over the rope pulleys 112. The remainder of the construction is almost identical with the structure shown in FIG. 1 through FIG. 3, and therefore the description is omitted.

Figure 8:
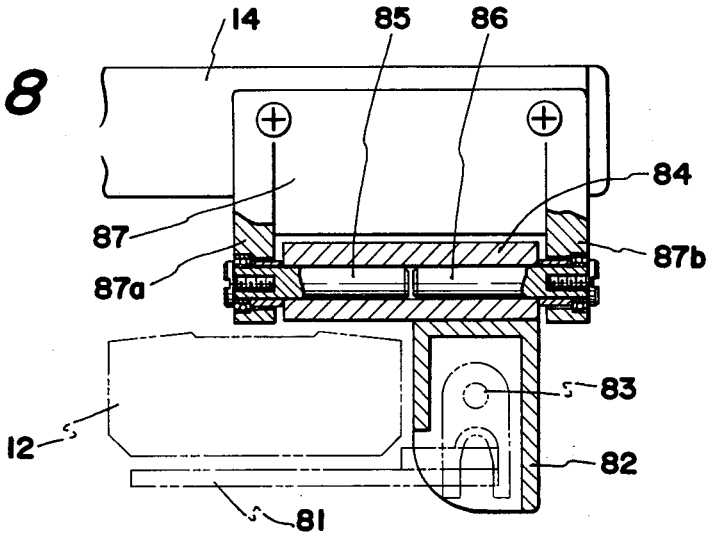
FIG. 8 is a cross-sectional view taken along line 8—8 of FIG. 1.

The head supported on the head support plate 116 is swivelable around the pivotal shafts 114 and 115 and shafts 117 and 118, and is capable of swiveling toward and away from the surface of the drawing board. Accordingly, in this embodiment, because the longitudinal cursor 11 and the head are coupled by a double hinge mechanism, as shown in FIGS. 7 and 8, the longitudinal rail is not required to be able to turn around an axis parallel with its longitudinal direction. When the ruler mounting plate free to turn relative to the head support plate 116, the magnitude of the turning moment generated in the gear 121 by the ruler mounting plate and straightedge is identical with the magnitude of the turning moment generated in the gear 122 by the weight of the balance weight. The gears 121 and 122 have applied thereto turning moments in mutually opposite directions, so that on the inclined drawing board, the straightedge is supported stably with the head support plate 116, and is not swung downwardly along the surface of the drawing board. Moreover, a dynamic force on the longitudinal cursor 111 tending to cause it to move downwardly along the inclined drawing board along the longitudinal rail is balanced by the dynamic force of the balance weight tending to move downwardly along the drawing board along the longitudinal rail; and even if the head is out of one's hand, the longitudinal cursor 111 and the head remain in a stable static condition at an arbitrary position on the inclined drawing board.

What is claimed is:

1. A rail type drawing apparatus having a straightedge supporting device, said apparatus comprising a cross rail disposed at a side portion of a drawing board, a cross cursor slidably mounted on the cross rail, a longitudinal rail connected to the cross cursor at right angles to the cross rail, a weight means mounted for shifting movement along the longitudinal rail, a longitudinal cursor mounted on the longitudinal rail for shifting movement therealong, a head connected to the longitudinal cursor, a ruler mounting plate rotatably mounted on the head, a straightedge means adjustably mounted on the ruler mounting plate, means for fixedly engaging the ruler mounting plate to the head and disengaging it therefrom, a rope means having one end connected to said weight means and having exerted thereon a force in one direction due to the effect on gravity on said weight, the other end of said rope means being coupled to said longitudinal cursor and having a force exerted thereon by the weight of said cursor, said head, said plate and said straightedge means in the opposite direction, and turning force converting means mechanically coupled between said ruler mounting plate and said rope means for converting the rotary motion of the straightedge means around the head in a plane parallel with the surface of the drawing board under the effect of gravity into a force opposite to the direction of the force exerted on the rope by the weight means.

2. A rail type drawing apparatus as claimed in claim 1 in which said weight means comprises a balance weight part for said longitudinal cursor and a balance weight part for said longitudinal cursor and a balance weight part for said straightedge means, said weight parts being mutually independent, and a said rope means comprises a first rope member coupled between said longitudinal cursor and said balance weight part for said longitudinal cursor with the longitudinal cursor exerting a force on said first rope member in one direction due to the effect of gravity thereon, and said longitudinal cursor balance weight part exerting a force on said first rope member in the opposite direction due to the effect of gravity thereon, and said rope means further comprising a second rope member coupled between said turning force means and said balance weight part for said straightedge means and having opposite forces exerted thereon due to the effect of gravity on said straightedge means and said balance weight part for said straightedge means.

3. A rail type drawing apparatus as claimed in claim 1 in which said weight means is a single weight and said rope means is a single rope connected to said longitudinal cursor for normally keeping said longitudinal cursor in a fixed position on said rope and allowing relative movement between said longitudinal cursor and said rope, and said turning force converting means is mechanically connected to said single rope on said longitudinal cursor for moving said single rope against the force exerted thereon by said weight when said straightedge means is turned relative to said head for adjusting the position of said straightedge means.

4. A rail type drawing apparatus as claimed in claim 3 in which said longitudinal cursor has guide rollers thereon through which said rope passes for frictionally holding said longitudinal cursor engaged with said rope, and said turning force converting means comprises a gear means coupled to said head for being rotated by a turning force applied to said head, a link eccentrically connected to said gear means, a crank pivoted on said longitudinal cursor and having one end connected to said lever and the other end connected to said rope.

5. A rail type drawing apparatus as claimed in claim 3 in which said turning force converting means comprises a gear means coupled to said head for being rotated by a turning force applied to said head, a link eccentrically connected to said gear means, a crank pivoted on said longitudinal cursor and having one end connected to said lever, a slider slidably mounted on said longitudinal cursor and to the opposite ends of which said rope is connected, said slider frictionally engaging said longitudinal cursor for holding said longitudinal cursor on said rope, and the other end of said crank being engaged with said slider for sliding said slider on said longitudinal cursor.

6. A rail type drawing apparatus as claimed in claim 3 in which said longitudinal cursor has guide rollers thereon through which said rope passes for frictionally holding said longitudinal cursor engaged with said rope, and said turning force converting means comprises a gear means coupled to said head for being rotated by a turning force applied to said head, and a further rope having one end eccentrically connected to said gear means and the other end connected to said rope for moving said rope relative to said longitudinal cursor.

* * * * *